US010391018B1

(12) United States Patent
Fitzwater

(10) Patent No.: US 10,391,018 B1
(45) Date of Patent: Aug. 27, 2019

(54) WALK AGAIN WALKER

(71) Applicant: Ronald Keith Fitzwater, Payette, ID (US)

(72) Inventor: Ronald Keith Fitzwater, Payette, ID (US)

( * ) Notice: Subject to any disclaimer, the term of this patent is extended or adjusted under 35 U.S.C. 154(b) by 0 days.

(21) Appl. No.: 16/138,237

(22) Filed: Feb. 19, 2019

Related U.S. Application Data

(60) Provisional application No. 62/561,564, filed on Sep. 21, 2017.

(51) Int. Cl.
*A61H 3/04* (2006.01)

(52) U.S. Cl.
CPC ..... *A61H 3/04* (2013.01); *A61H 2201/0161* (2013.01); *A61H 2201/1635* (2013.01); *A61H 2203/0406* (2013.01)

(58) Field of Classification Search
CPC ..... A61H 3/04; A61H 2003/046
See application file for complete search history.

(56) References Cited

U.S. PATENT DOCUMENTS 2,278,901 A * 4/1942 Smock ..... A61H 3/04 482/67
2,667,914 A * 2/1954 Forbes ..... A61H 3/04 135/69
2,732,004 A * 1/1956 Forbes ..... A61H 3/04 482/67
5,224,717 A * 7/1993 Lowen ..... A61H 3/04 135/67
5,657,783 A * 8/1997 Sisko ..... A61H 3/00 135/66
6,206,019 B1 * 3/2001 Horvitz ..... A61H 3/00 135/66
7,559,560 B2 * 7/2009 Li ..... A61H 3/04 16/35 R
7,677,259 B1 * 3/2010 Arbuckle ..... A61H 3/04 135/66
7,708,120 B2 * 5/2010 Einbinder ..... A61H 3/04 188/19
8,234,009 B2 * 7/2012 Kitahama ..... A61H 3/061 700/245
8,540,256 B1 * 9/2013 Simpson ..... A61H 3/00 135/67
8,740,242 B2 * 6/2014 Slomp ..... B26B 3/02 135/67
8,794,252 B2 * 8/2014 Alghazi ..... A61G 5/085 135/66

(Continued)

*Primary Examiner* — Noah Chandler Hawk

(57) ABSTRACT

A foldable upright wheeled walker with adjustable armpit cushions and support frames that supports a sufficient user body weight to facilitate a natural gait and provide unassisted mobility for a wide range of mobility impaired individuals. The invention may be folded and unfolded for compact storage or transportation. The device includes large rubber tires on a caster wheel assembly and includes one or two mechanical friction brakes actuated at the levers attached to the handgrips on each side of the device. The user stands or walks within the polygonal footprint defined by the front and rear wheels with arms over the armpit cushions to provide upper-body support without resting significant weight on the user's wrists or arms or standing and walking stooped over, minimizing risk of falling.

3 Claims, 11 Drawing Sheets

(56) References Cited

U.S. PATENT DOCUMENTS

| | | | | |
|---|---|---|---|---|
| 8,998,223 | B2 * | 4/2015 | Chang | F16D 59/02 188/20 |
| 9,221,433 | B2 * | 12/2015 | Dunlap | A61H 3/04 |
| 9,486,385 | B1 * | 11/2016 | Terrill | A61H 3/04 |
| 9,707,149 | B1 * | 7/2017 | Juarez | A43B 5/0419 |

* cited by examiner

WALK AGAIN WALKER

BACKGROUND OF THE INVENTION

1. Field of the Invention this invention relates generally to assistive mobility devices and more specifically to a collapsible upright wheeled weight-bearing walker.

2. Description of Related Art

Assistive mobility devices, including walkers, are well-known in the art as useful means for reducing the disadvantages of mobility impairment suffered for many different reasons by many people, permitting more efficient ambulation over distance and thereby increased independence. Data from the National Long-Term Care Survey suggests that increased use of assistive technology may have helped reduce disability at older ages. [Manton, et al., "Changes in the Use of Personal Assistance and Special Equipment from 1982 to 1989: Results from the 1982 and 1989 MACS," *Gerontologist* 33(2):168-76 (April 1993)]. Although mobility device users represent a relatively small minority of the population with disabilities, their importance transcends their numbers because mobility devices are visible signs of disability and have become symbols of the very idea of disability. And the mobility-impaired population is increasing much faster than the general population [LaPlante et al., "Demographics and trends in Wheeled Mobility Equipment Use and Accessibility in the Community," *Assistive Technology,* 22, 3-17, (2010)]. Accordingly, there has long been a growing demand for improved mobility assistance devices adaptable for improving ambulation for mobility-limited persons.

Martins et al. [Martins et al., Assistive Mobility devices focusing on Smart Walkers: Classification and Review, *Robotics and Autonomous Systems* 60 (4), April 2012, pp 548-563] classifies mobility assistance devices into the alternative devices intended for those with total loss of independent mobility (wheelchairs or autonomous powered vehicles) and assistive or augmentive devices for those with residual mobility capacity (prostheses, crutches, canes and walkers). For several reasons, most impaired individuals prefer to avoid association with the alternative devices associated with total incapacity. Similarly, the rehabilitation profession strongly prefers the assistive devices, which can be used for physical therapy and as mobility-training devices. Accordingly, there has long been a growing demand for improved assistive devices adapted for use by the less disabled among those who otherwise cannot move independently with existing assistive devices and rely on alternative devices such as wheelchairs and powered scooters.

Mobility and manipulation are critical to living independently and are often strongly associated with the ability to continue to live safely in one's home. Simple assistive devices such as crutches, canes, walkers and rollators (rolling walkers) can assist a person who has the endurance and strength to walk distances, but these devices must also provide some support or feedback to keep the person from losing their balance or enable the person to rest, when necessary. Although the impaired individual may eventually need an alternative device like a wheelchair or powered scooter, most strongly desire to retain the independence of the simpler assistive devices for as long as possible. For this reason, there is a well-known and long-felt need for assistive device improvements that facilitate independent ambulation for the progressively more impaired individuals.

Although popular, the most common assistive devices known in the arts (canes, walkers, and rollators) have many well-known disadvantages; even for the relatively mobile individual.

The typical wheeled walker known in the art has many well-known disadvantages; such as requiring a stooping or forward leaning posture to avoid a hobbled gait, difficulty in smooth transition over irregular terrain, little or no upper body and arm support, and requiring significant hand arm strength to maneuver and to operate any hand brake, for example. A stooping posture stress the user's back and arms and risks tipping forward when encountering terrain obstacles. And most devices known in the art have no wheels or wheels too small to negotiate even small surface irregularities safely. Some devices are too heavy or awkward for an unassisted user to lift into a car or trunk or van, which limits adds risk of falls and injury and limits independence.

The typical wheeled walker known in the art is neither designed nor intended to support significant user weight during use. As with a cane, the accepted purpose of a wheeled walker is simply to provide assistance in balance and gait, like an elaborate cane system. So the user engages the walker with hands and wrists alone, often with a stooping or forward-leaning posture. The impaired user generally lacks the hand and wrist strength needed to continuously support significant upper body weight while walking in a stooped or leaning position. Some wheeled walkers eliminate the seat to afford a more open walking footprint for the user. While this permits an improved and more natural walking position it offers no improved weight bearing capability and many users need an included seat to facilitate independent use over longer distances.

The mobility assistance with suggestions for improving wheeled walkers.

For example, in U.S. Pat. No. 8,100,415, Kindberg et al. disclose a wheel suspension that facilitates curb climbing when used with large wheels in, for example, a rollator But Kindberg et al. limit their teachings to negotiating uneven terrain such as curbs. In U.S. Pat. No. D561,065, Kindberg et al. also disclose a walker frame design.

And for example, in U.S. Pat. No. 8,840,124, Serhan et al. disclose a safety brake in a rollator that improves the safety of seated users by using a breaking system that locks the rollator when the user sits down on the rollator seat and releases the wheels when the user stands up. As another example, in U.S. Pat. No. 7,052,030, Serhan discloses a wheeled walker with cross-member supports adapted to permit both seat and basket with wheel sizes greater than seven to eight inches. In U.S. Pat. No. 6,886,575, Diamond discloses a locking assembly for use with a walker having foldable side members. And for example, in U.S. Pat. No. 8,678,425, Schaaper et al. disclose a wheelchair having a movable seat element facilitating use as a rollator.

In U.S. Pat. No. 8,740,242, Slomp discloses a posterior walker configured to encourage a neutral spine during use. And for example, in U.S. Pat. No. 7,559,560, Li et al. disclose a rollator having a foldable seat element.

Some practitioners propose improving the walker mobility aid by adding upper support means for supporting the user's forearms, hands, or shoulders to improve user comfort and posture. For example, in U.S. Pat. No. 5,657,783, Sisko et al. disclose accessory forearm rests that may be mounted to any conventional invalid walker, preferably disposed above the normal hand-grips to provide support for the user's arms.

Such an upright wheeled walker may permit the user to walk upright but the walker known in the art is not adapted to support any user body weight beyond the relatively small portion in the forearms and hands. For example, in U.S. Pat. No. 8,540,256, Simpson discloses a walker with a forearm support frame to permit an upright user to step forward with the walker footprint but little or no weight bearing capability.

Improving a wheeled walker by adding an upper-body support is advantages because it facilitates an upright walking and standing posture, improved gait and comfort. But adding significant user body weight to the common wheeled walker is also disadvantageous for stability. The increased weight borne on each wheel affects walker stability, braking and terrain handling. For example, adding significant upright weight support to the common wheeled walker introduces new disadvantages of increased lateral and longitudinal instability, risking falls and affecting user safety. Adding more weight support at a higher point on the walker increases the tipping torque at the wheels because of the increased force and distance. Any wheeled walker has longitudinal stability problems when rolling on slopes and over irregular terrain, which may imperil user safety by causing falls during use. This longitudinal instability problem is exacerbated by the fluctuating wheel loads imposed by the applied user weight during stepping, introducing a new lateral instability.

Several practitioners suggest improvements to mitigate the wheeled walker longitudinal stability problem with braking system improvements. For example, in U.S. Pat. No. 8,998,223. Chang discloses a wheel braking system for a rollator with a "dead-man brake" whereby the wheels are halted upon the release of the user's hands from the handles, improving user safety on slopes. Similarly, in U.S. Pat. No. 9,221,433, Dunlap discloses a safety braking system for a rollator that includes a park mode, a walk mode and a brake mode with a handlebar control mechanism.

Recognizing these new instability problems, practitioners have suggested turning to a powered vehicle to permit some user weight support in assistive devices. Foe example, in U.S. Pat. No. 8,794,252, Alghazi discloses a mobility apparatus with an integrated power source and four wheels so a user can stand on it and drive it as an electric mobility device, or disable it and use it as a passive walker. His device is collapsible and includes a pair of supporting beams disposed to support the user under the armpits, but such support does little to improve posture or stability while walking with the passive device. And in U.S. Pat. No. 8,234,009, Kitahama discloses an autonomous mobility apparatus that moves autonomously along near a specified person (user) while detecting and evaluating the surroundings to assess the danger level to the user, moving as necessary to avoid danger to the user based on the danger level detected.

Others have proposed elaborate powered control systems to address these stability and other user safety problems. For example, in U.S. Pat. No. 7,708,120, Einbinder discloses an improvement to user safety consisting of a wheeled walker braking system using a controller and electrically actuated wheel brakes to provide push-button user control over braking and processor-controlled braking responsive to, for example, user hand position and the terrain slope.

But such devices may be generally perceived by users as alternative devices (such as powered wheel chairs, stair climbers and vehicles) and do not represent the improved assistive device sought by most users.

These and other examples of the mobility assistance art demonstrate that there is a continuing long-felt need for improved solutions to the walking posture, seating, weight support and portability problems discussed above.

These unresolved problems and deficiencies are clearly felt in the art and are solved in the manner described below.

SUMMARY OF THE INVENTION

This walking assistance device is designed to overcome the shortcomings of crutches, common walker and wheelchairs. Similar to crutches, it holds a portion of the user's weight with support under the user's armpits and has a place for the user to grip a handle for added support and control. Similar to a common walker, it has a three-sided frame with an opening on the anterior of the device. Unlike crutches and walkers, this device inherently provides added stability and control as the user can stand and walk in a fully erect posture, support some amount of weight under their arms without the requisite use of one or both hands and remain well balanced without the fear of toppling over. The left and right-side frames are mirrored with the possible exception of the handbrake if only one is installed.

The rear frame holds the left and right sides in place. All three sides have crossbars that can both fold and expand in length and are attached are attached horizontally to the vertical frame members. Each of the four vertical frame members have adjustable sections towards the top, allowing for proper height adjustment. At the top of each side is a molded foam piece meant to fit in front of the shoulders and under the arms from the anterior to posterior vertical members. Stretched between the left and right frames at the top section of the posterior frame is a flexible molded backrest piece.

The frame is made from metallic tubes, some shaped and some straight sections and connected by metallic joints, pins, and bars. Both side frames consist of an anterior, 360 pivoting caster wheels with rubber tires, the assembly of which is attached to an upright tube assembly whose height can be adjusted in the upper section just below the armpit support piece. Below the expandable joint is an adjustable hand grip with optional handbrake mechanism. The handbrakes are attached to the anterior vertical tubes by metallic joint allowing its relative height to be adjusted up or down and can be rotated from perpendicular sticking outward 90 degrees to point toward the posterior of the device. The handbrake utilizes a sheathed cable that actuates the brake mechanism on the rear fixed caster wheel assembly with rubber tires and optional brake mechanism. There are two crossbars on each side frame on the lower sections that hold the anterior and posterior vertical tubes at incremental distances and are attached to the tubes with metallic joins that allow the crossbars to be folded upwards. The crossbars have a joint at the midpoint that allows the tubes to be folded upwards and the length to be adjusted incrementally with a positive-locking pin-in-notch, dimple spring, mechanism.

The posterior frame is similar in construction as the sides, in that there is an upper and lower crossbar that folds and has adjustable length but folds downward. Each held to the vertical tubes by metallic joints allowing for such action. The upper section of each posterior vertical tube height adjustments matching those on the anterior tubes. All of the folding joints each must have a positive locking mechanism that is reasonably easy to engage and disengage without the likelihood of accidentally allowing the crossbar to inadvertently fold. Each of the crossbar vertical joints must accommodate the ability of the fold only in the proper direction.

Adjustment lengths should be secured by incremental notches or holes held securely by a spring-loaded pin that can be depressed to allow the tubes to be pulled or pushed to the desired increment.

The tall, three-sided trapezoidal shape, with a wide and deep stance allows for increased stability and comfort compared to either crutches or common walkers. The width of the device should not be adjustable beyond the width of an ADA compliant doorway such that the caster wheels would not fit easily through. The anterior-posterior depth should adjust enough to allow a tall individual sufficient space for their shoulders and arms to fit comfortably within the cushioned armpit supports. The armpit supports must be comfortable and functional. They are intended to support a significant amount of the user's weight without stretching or significantly deforming. The anterior of the armpit should be high enough to allow the user to push against it to facilitate locomotion. The armpit supports should be reasonable soft as to not interfere with one's blood circulation through the arms.

The backrest is securely attached to the top section of the posterior frame and is no taller than the shortest adjustment of the posterior armpit support section. It must be flexible enough to accommodate the folding of the entire device (as the sides and back can be collapsed towards each other for storage or transport).

In general the device is a trapezoidal shape. The base of the device shall not be wider than ADA compliant doorways and the top of the device must be only as narrow as the user's chest at the height of the armpits. This is the reason for the posterior width adjusting crossbars. The anterior-posterior depth at the top of the device is much narrower than at the base and is set back from the center of the device. The side frames are angled such that the base is much longer front-to-back than at the top of the device creating a long wheelbase. However, the exact angle is not determined (and may not need to be any specific degree away from perpendicular). The anterior vertical tubes angle towards the back more so than the posterior tubes angle forwards. Those angles could change if the if the upper and lower crossbars are not adjusted proportionally, resulting in a potential interference with the proper alignment of the caster wheels. Hence the recommendation to use incremental notches or holes that can be enumerated.

BRIEF DESCRIPTION OF THE DRAWINGS

For a more complete understanding of this invention, reference is made to the following detailed description of the embodiments as illustrated in the accompanying drawings, in which like reference designations represent like features throughout the several views and wherein:

FIG. 4A-C are right side views of the upright wheeled walker embodiment of FIG. 1, adjusted to maximum and minimum heights and a folded nominal height;

DETAILED DESCRIPTION OF THE EMBODIMENTS

Figure 1:
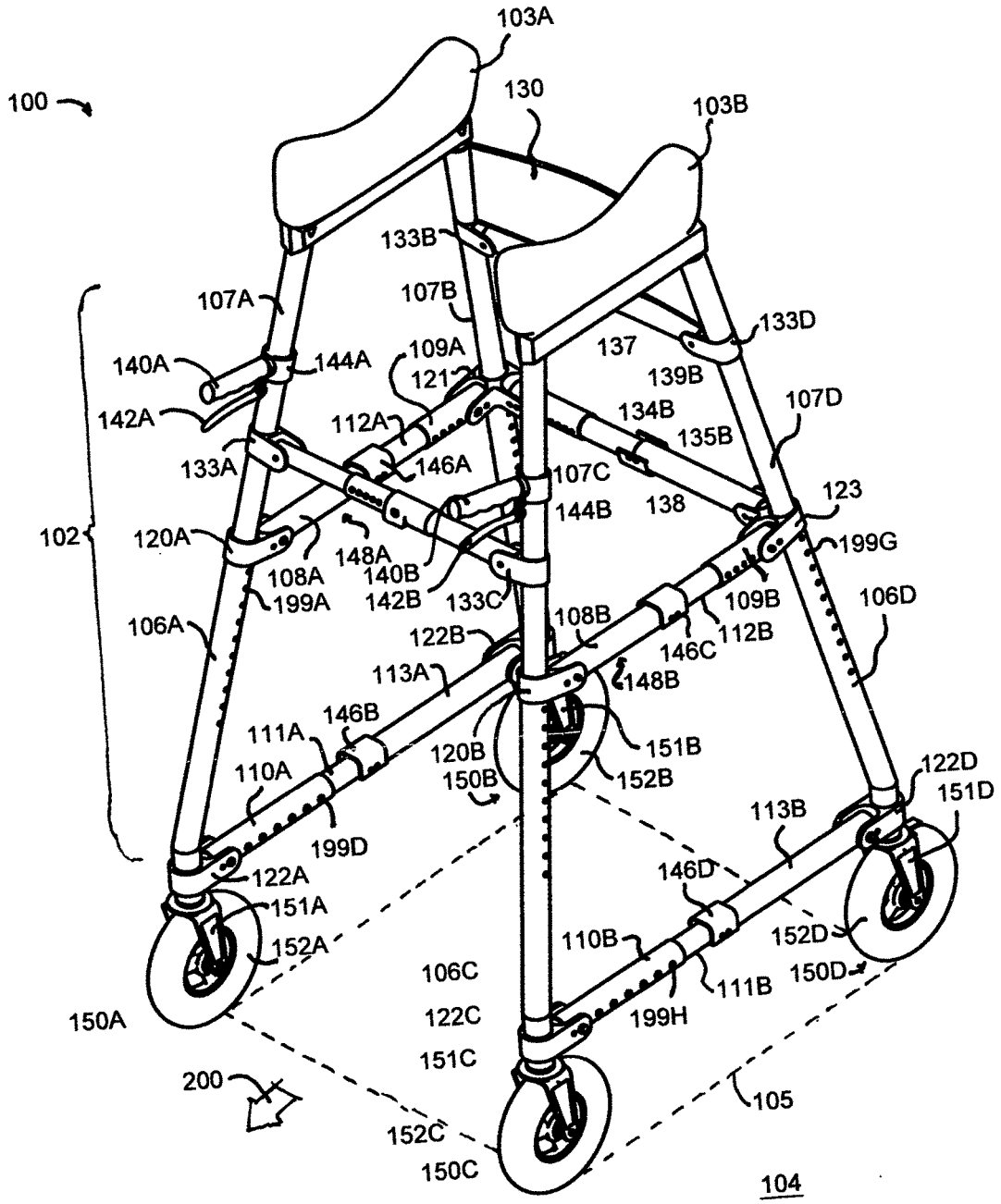
FIG. 1 is an oblique upper left front view of an exemplary embodiment of the upright wheeled walker of this invention, walk again walker.

FIG. 1 shows a foldable upright wheeled walker device, 100, with a main upright frame, 102, supported above a walkable surface, 104, on four caster wheel assemblies, 150A-D, inclusive of right wheel assemblies, 150A-B under the right-side frame portion and 150C-D under the left side frame portion of the walker. Frame 102 includes the right side trapezoidal frame assembly inclusive of two upper supports, 107A-B that slip-adjust within their respective lower receiver tubes, 106A-B, supported by the caster wheel assemblies, 150A-B and connected by an adjustable length foldable assembly at the bottom, 149A, in the middle by an adjustable length folding assembly, 148A, and at the top with armpit cushion assembly 103A; and the left side trapezoidal frame assembly inclusive of two upper supports, 107C-D that slip-adjust within their respective lower receiver tubes, 106C-D, supported by the caster wheel assemblies, 150C-D and connected by an adjustable length foldable assembly at the bottom, 149B, in the middle by an adjustable foldable length assembly, 148B, and at the top with armpit cushion assembly 103B. The right frame and left frame are connected at the back side of the apparatus with the bottom foldable cross-brace assembly, 138, at the middle foldable cross-brace assembly, 137, and at the top with the soft back-strap, 130. Wheel assemblies 150A-D each consists respectively of a tire/wheel assembly, 152A-D, and a respective caster assembly, 151A-D that is fixed to the frame, 102, at the vertices of the polygonal footprint, 105, on the walking surface, 104, and are specifically described in connection of FIG. 5A, front wheel assembly 150C and FIG. 5B, rear wheel assembly 150C (with brake mechanism) below. Each of the four upper supports, 107A-D, is inserted into and slidably engaged with a respective lower support tube, 106A-D. Each of the internal locking pins, 199A-H, are engaged in a respective lower support tube, 106A-D, and operate to lock the respective slidably engaged upper support 107A-D at a selectable elevation above the walking surface, 104, for a particular user's height and each of the adjustable side brace support members, 112A-B are inserted into and slidably engaged with a respective side support tube, 109A-B; and adjusted in concert in similar fashion with 111A-B in 110A-B and adjusted to a suitable length based on the geometry of the selected hight.

FIG. 1 also shows the hinges of the V-fold apparatuses, 146A-D and 139A-B, which are useful for folding the upright wheeled walker, 100, for convenient storage and transport as described in FIG. 3B and FIG. 4B, below.

Figure 7:
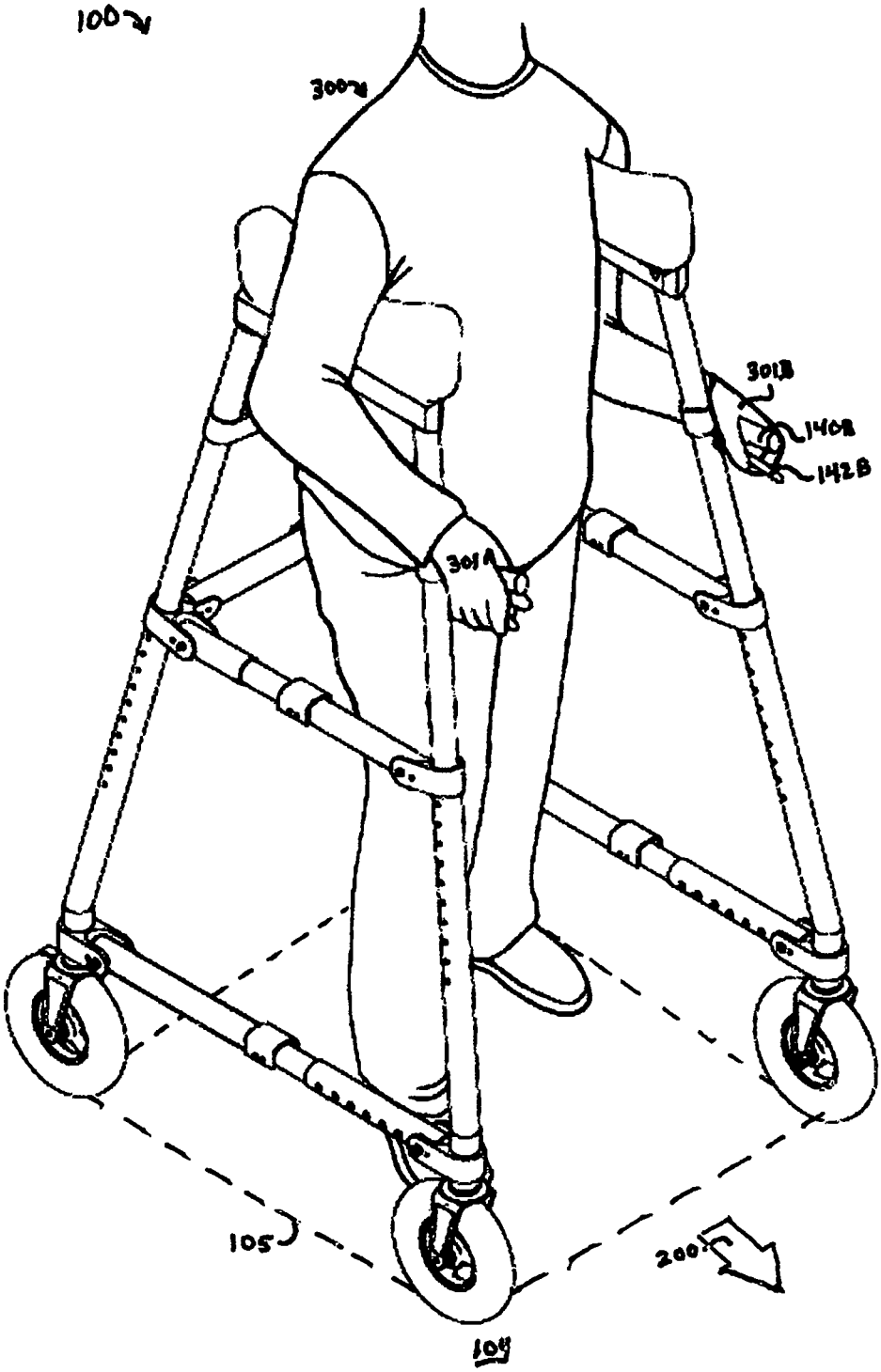
FIG. 7 is an oblique view of a user standing in a partially supported position within the polygonal footprint of the upright wheeled walker embodiment of FIG. 1.

Referring to FIG. 7, during use, shows a user, after adjusting the upper supports 107A-B to a desired elevation above surface 104, a user, 300, stands and steps within footprint, 105 on walking surface 104 between frame sides with arms, 302A-B, outside of the armpit cushions, 103A-B with each hand, 304A-B gripping on the handgrip, 140A-B and handbrake lever, 142A-B, as needed to actuate the rear friction brake, 157A-B. User 300 may then walk forward in the direction shown by the arrow, 200, as upright wheeled walker rolls over the surface, 104 while supporting at least some weight with armpit cushions, 103A-B, reducing user leg effort and improving user stability and thereby augmenting the user's ability to step along surface 104 without the assistance of another person.

Figure 2:
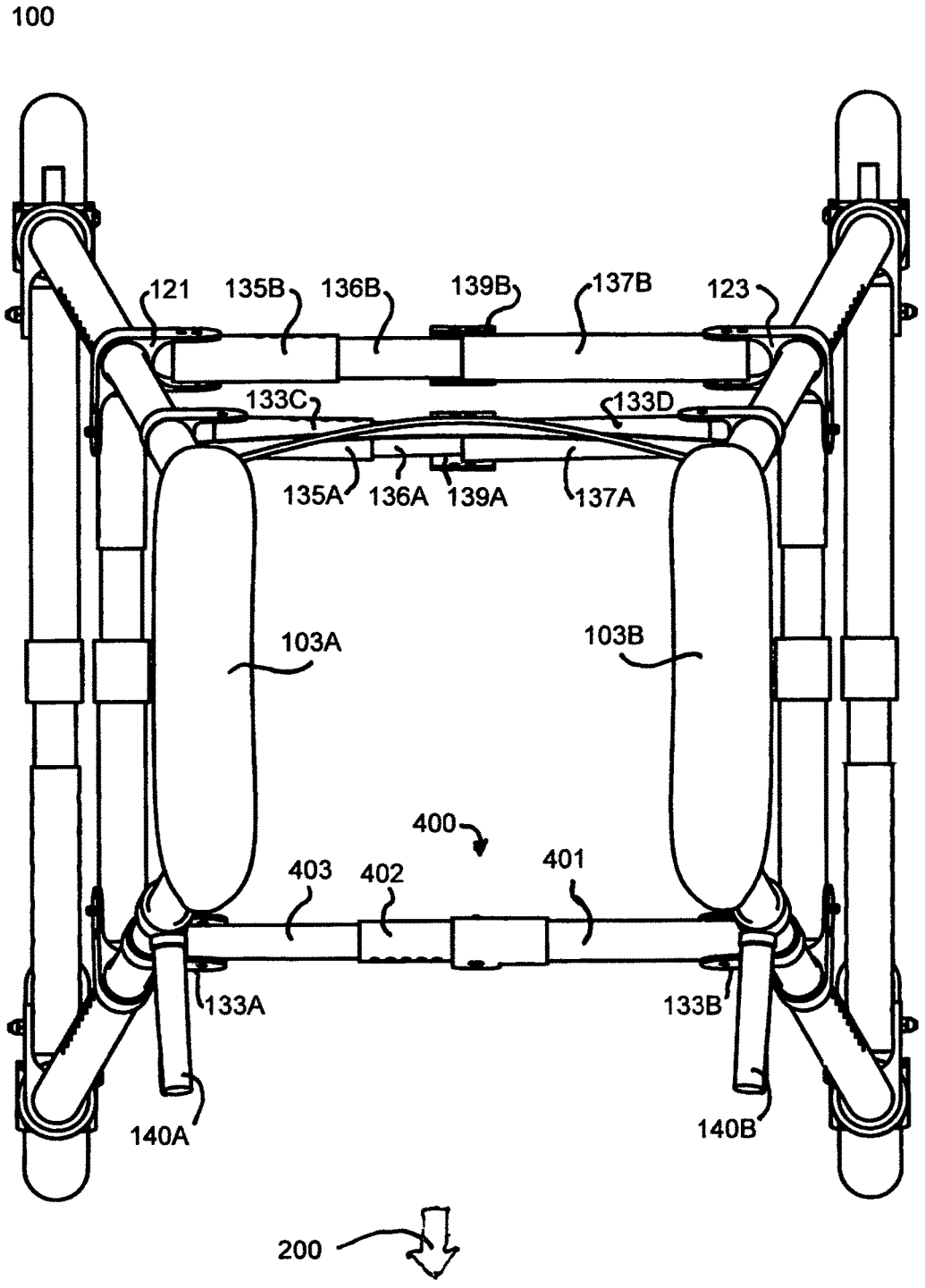
FIG. 2 is a top view of the upright wheeled walker embodiment of FIG. 1 illustrating the plan view of the polygonal footprint defined by the four wheels and the support elements of this invention.

FIG. 2 shows a top view of upright wheeled walker, 100, to better illustrate several components comprising the apparatus. Like numerals represent like features to those discussed above in connection with FIG. 1. In particular, FIG. 2 shows the trapezoidal stance and the preferred position of the adjustable hand-grips, 140A-B. FIG. 2 also shows the front crossbar assembly 400.

Figure 3A:
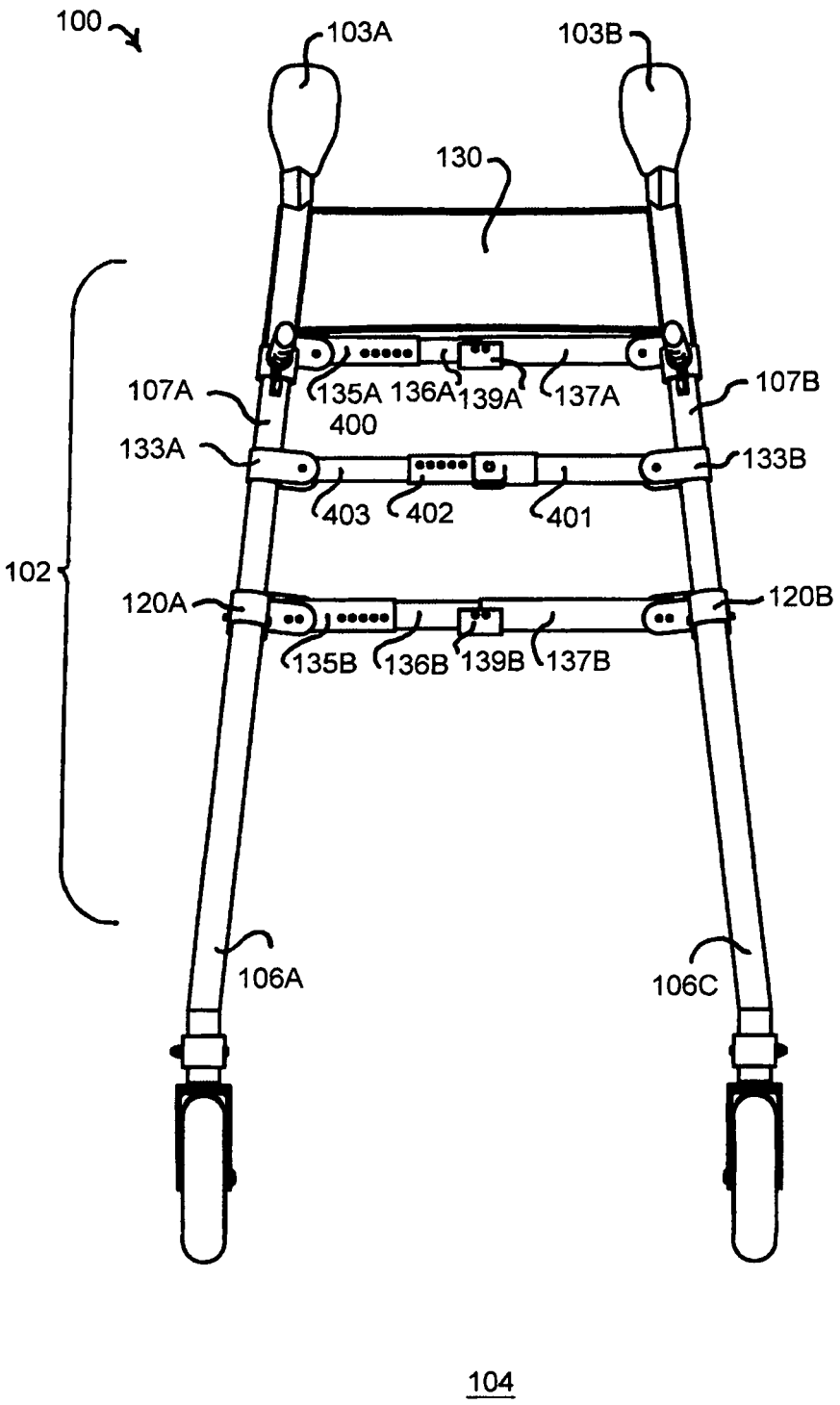
FIG. 3A-B are front views of the upright wheeled walker embodiment of FIG. 1, showing this invention in normal and folded orientations.

FIG. 3A shows a front view of upright wheeled walker, 100, in a normal mode of operation adjusted maximum height for an atypically taller than average stature user, 300, whereupon each of the upper support braces, 107A-D are extended out from the lower support braces, 106A-D at front brackets 120A-B and rear brackets, 121 (not shown) and 123 (not shown). At the time of the height adjustment for a particular individual, the front safety brace assembly, 400, is adjusted for suitable length at 402 and the rear cross brace assemblies are adjusted for stability at 135A-B.

Figure 3B:
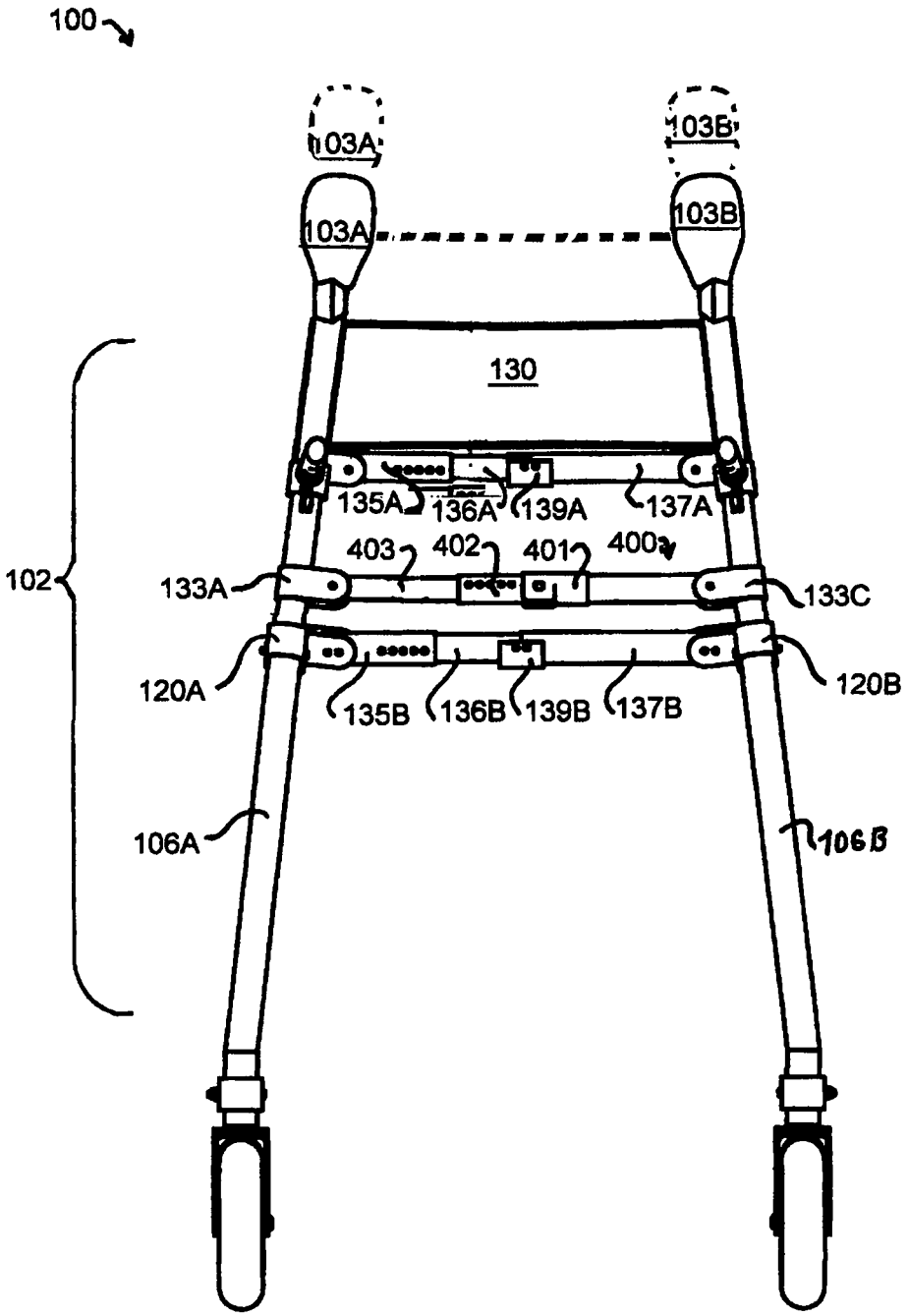
Figure 3C:
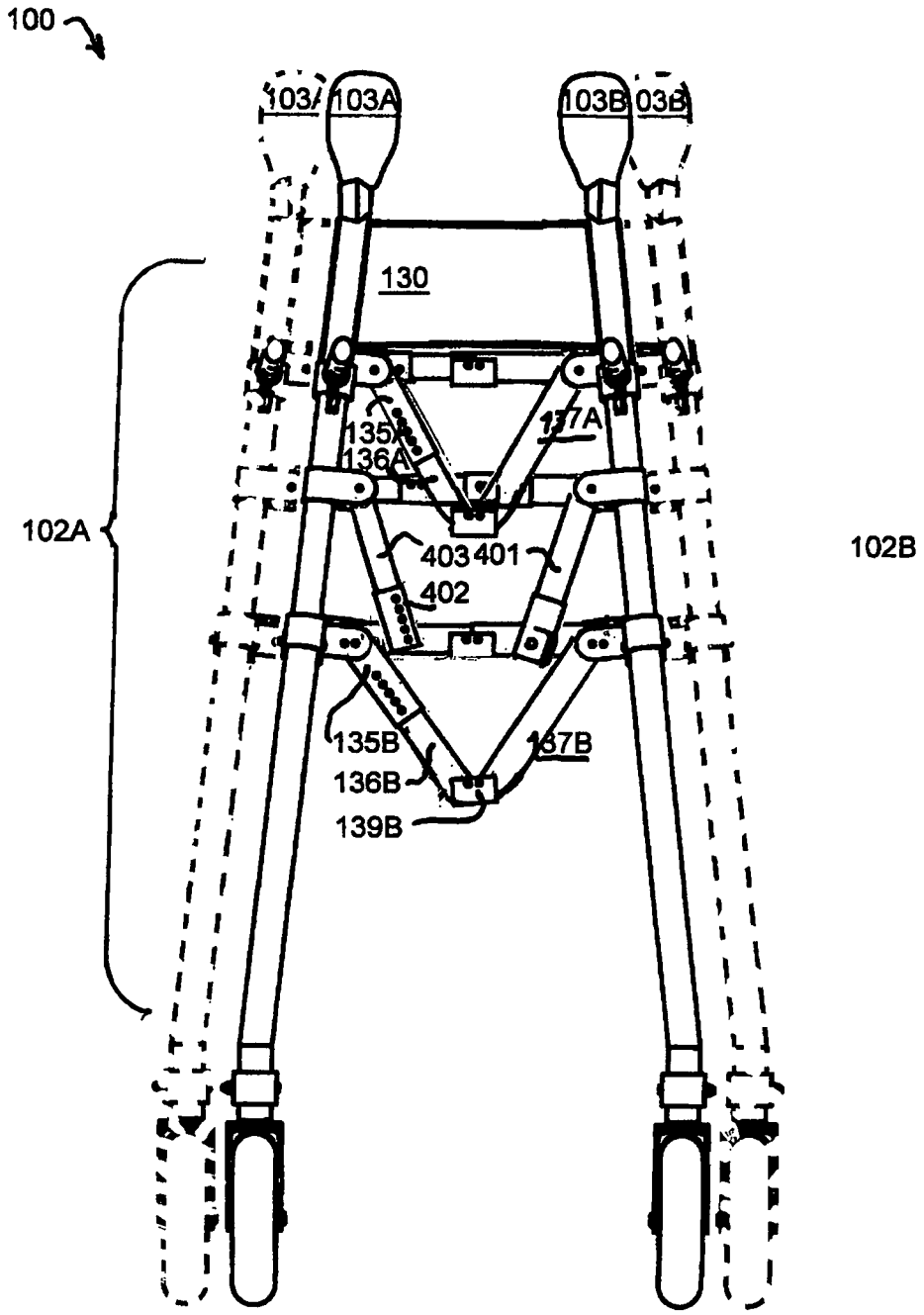

FIG. 3B shows a front view of FIG. 3A, of upright wheeled walker, 100, in a minimum height configuration adjusted for an atypically shorter stature user, 300, whereupon each of the upper support braces, 107A-D are extended out from the lower support braces, 106A-D at front brackets 120A-B and rear brackets, 121 (not shown) and 123 (not shown). At the time of the height adjustment for a particular individual, the front safety brace assembly, 400, is adjusted for suitable length at 402 and the rear cross brace assemblies are adjusted for stability at 135A-B. FIG. 3C shows a front view of FIG. 3A, of upright wheeled walker, 100, in a collapsed configuration useful for storage or transportation. The upright rolling walker, 100, may be folded from the fully open configuration to the fully collapsed configuration by compressing the dimple spring lock mechanisms, 147A-F (not shown as is an internal part). Once the front-cross brace assembly is loosed at locking joint, 401-402, the remaining locking-joints, 139A-B on the posterior frame, as top right rear brace assembly, 135A and 135A, rotate downward on the right and top left rear brace, 137A, rotates downward on the left. Likewise, bottom right brace assembly, 135B and 136B and bottom left brace also rotate downward, coordinated efforts cause the right side 102A and left side 102B come together in a smaller profile. Since the back rest, 130, is a fully flexible material, it simply folds upon itself.

Figure 4A:
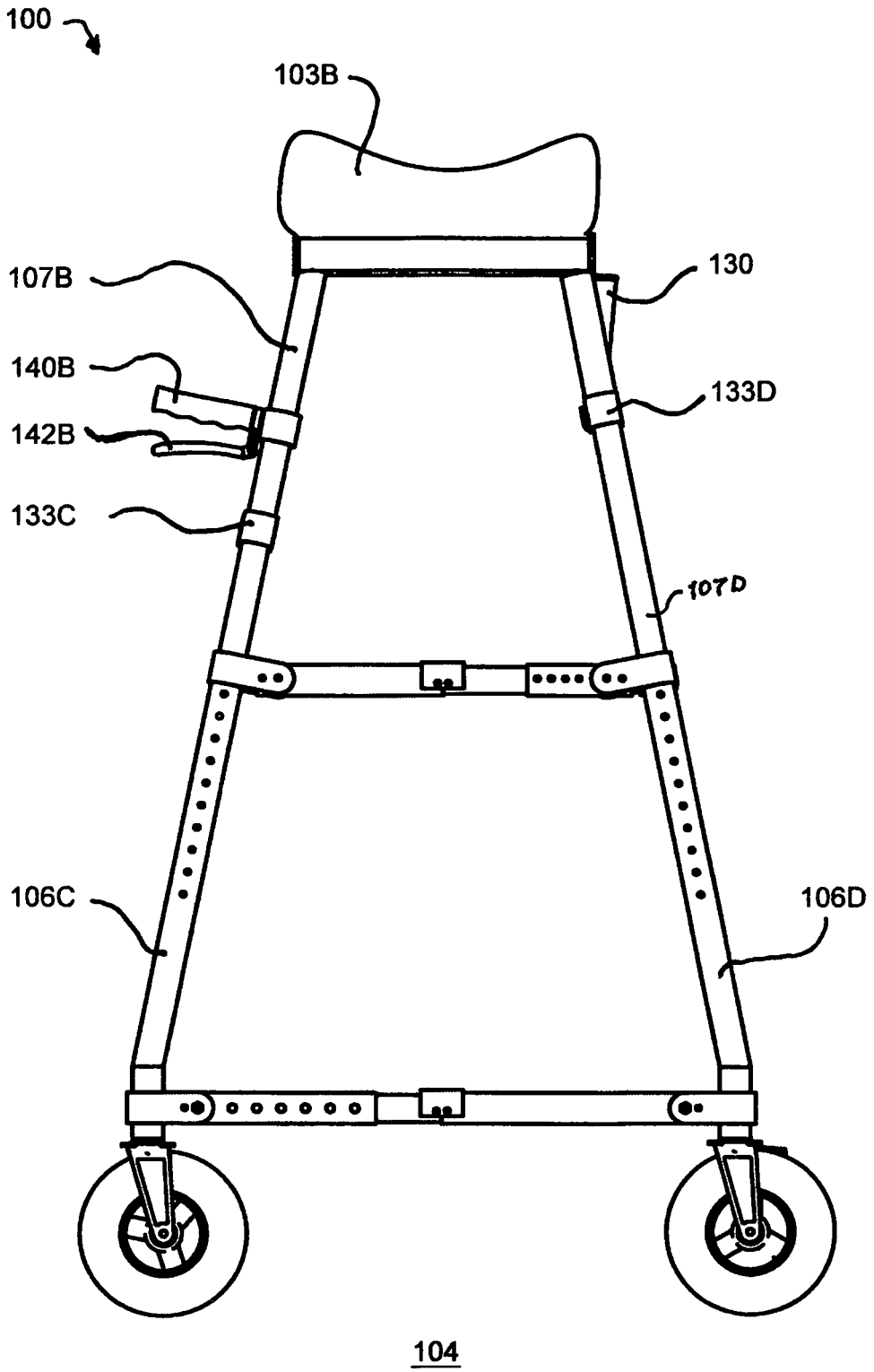

FIG. 4A shows a left side view of upright wheeled walker, 100, with upper front left support brace, 107B, and upper rear left support brace, 107D adjusted for a nominal height.

Figure 4B:
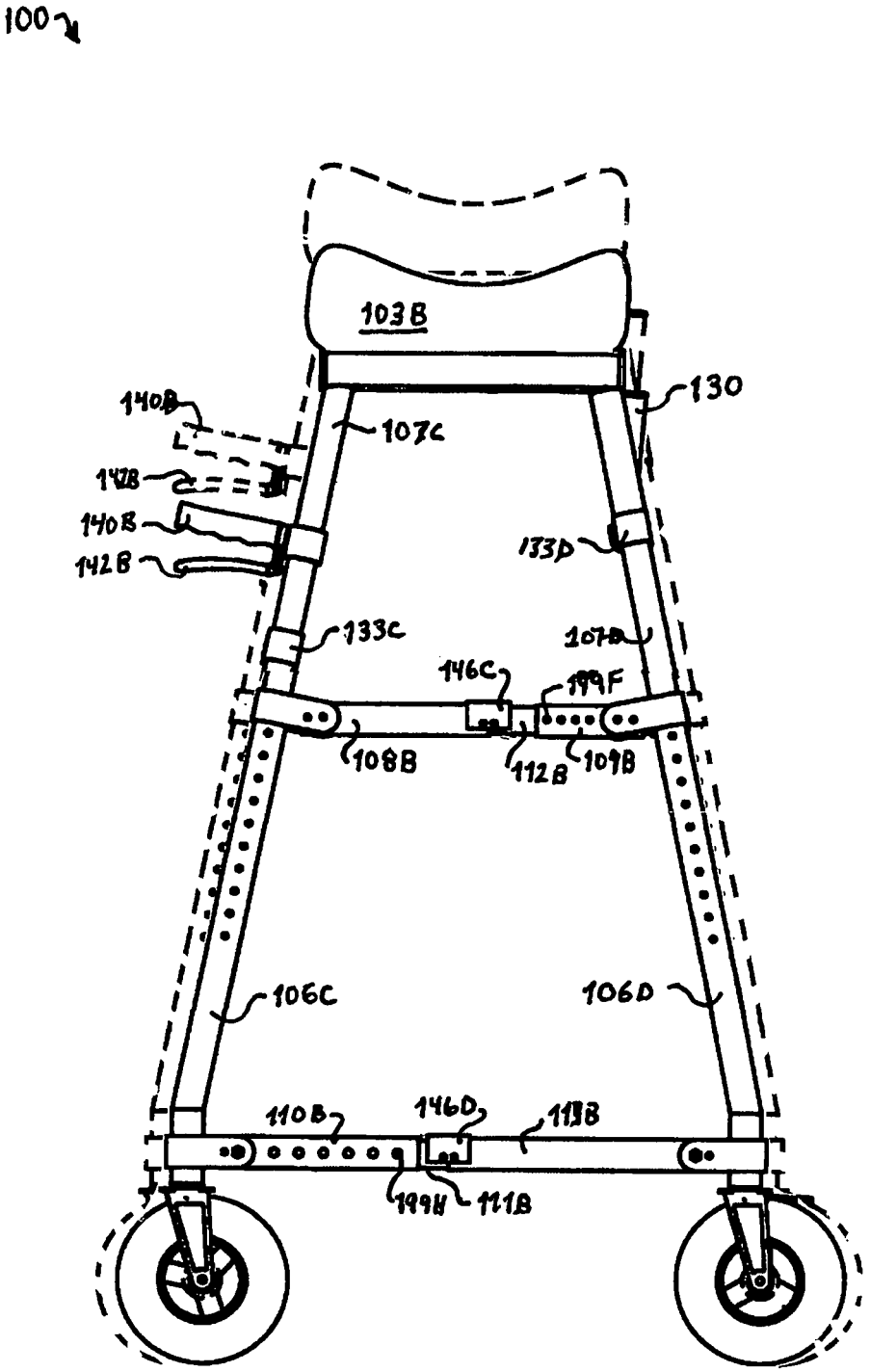

FIG. 4B shows a left side view of upright wheeled walker, 100, with upper front left support brace, 107B, and upper rear left support brace, 107D adjusted for a shorter stance, whereupon, the bottom brace assembly 110B, 111B, and 113B is adjusted for stable length with dimple-pin 199H and the top brace assembly 108B, 112B, and 109B is adjusted for stable length with dimple-pin 199F.

FIG. 4C shows left side view of upright wheeled walker, 100, in a nominal height configuration compacted for storage or transportation, with the arrows showing rotation of the side brace assemblies, 108B, 146C, 112B, 109B, 110B, 11B, 146D, and 113B rotated upwards.

Figure 5A:
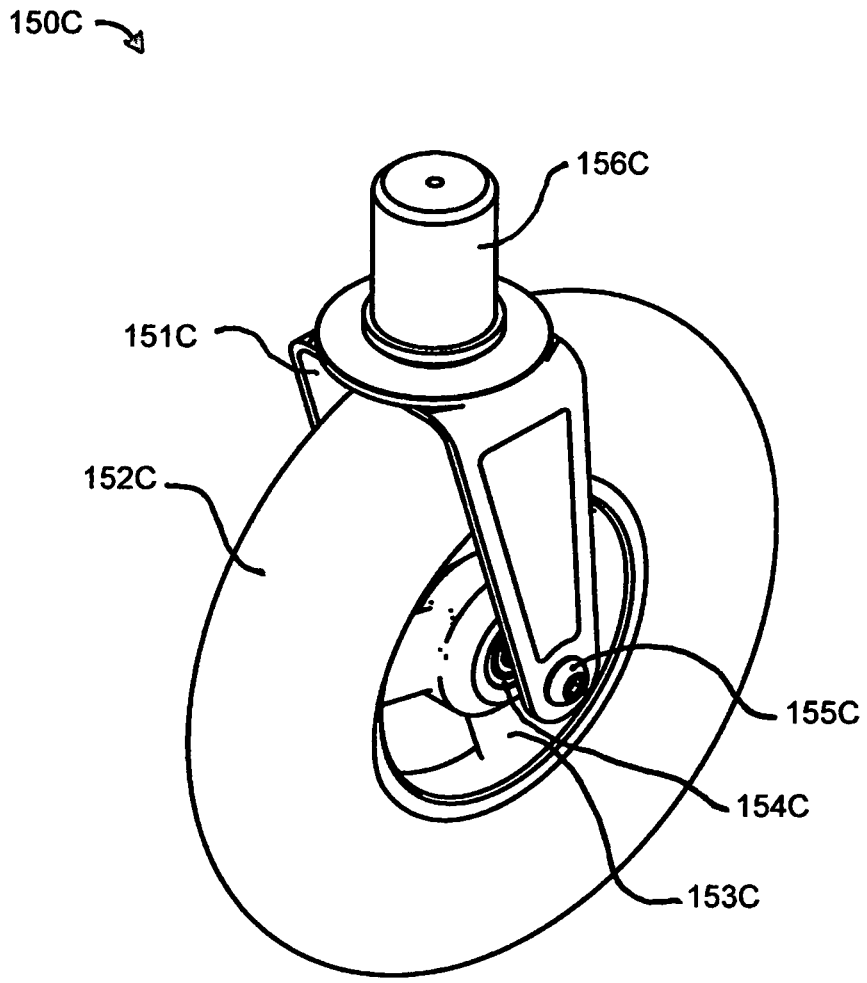
FIG. 5A-B are close-up oblique views of the left front and left rear wheel assemblies respectively of the upright wheeled walker embodiment of FIG. 1.
Figure 5B:
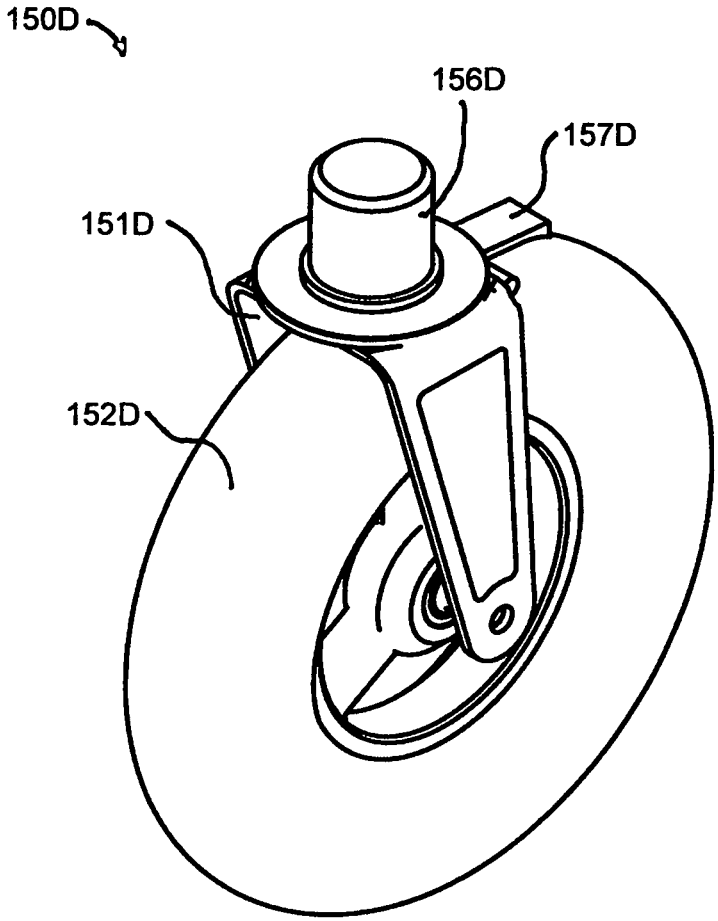
Figure 6:
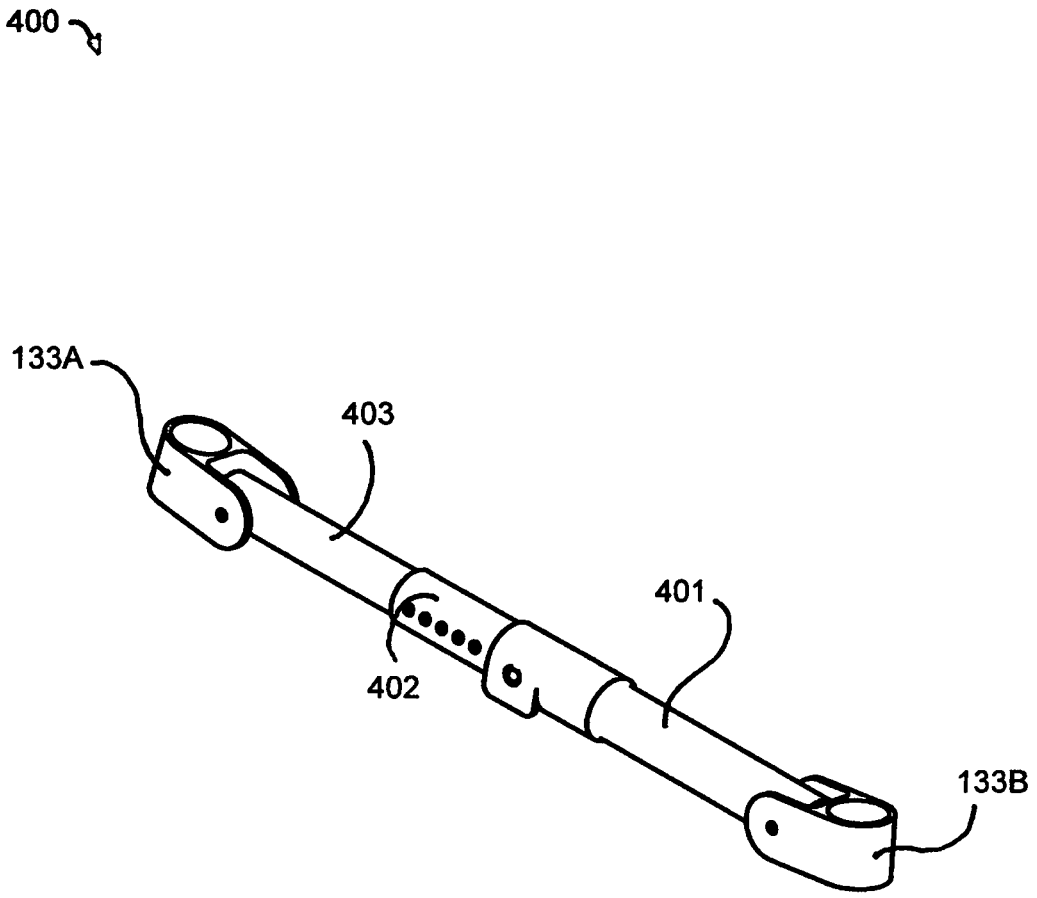
FIG. 6 shows a view of the locked front safety crossbar of the upright wheeled walker embodiment of FIG. 1.

FIG. 5A shows one of the two front caster wheel assemblies, 150A and 150C; FIG. 5B shows one of two rear caster wheel assemblies with cable actuated friction brake, 157B, (cable not shown) manually manipulated at the handbrake lever, 142B (not shown);

FIG. 6 shows the safety crossbar, 400, which connects to and pivots at each end affixed to 133A-B, having an adjustable length from brace 403, pinned in to place at one of the holes slip-tube, 402. Slip-joint, 402, is detached from the lock-bar, 401, allowing ingress and egress from the apparatus, 100.

FIG. 7 shows a user, 300, in the apparatus, 100, with a normal stance within the walking footprint, 105, gripping the hand, holding the individual's hands, 301A-B on the handgrips, 140A-B and handbrakes, 142A-B, and headed in the direction of preferred travel, 200.

Clearly, other embodiments and modifications of this invention may occur readily to those of ordinary skill in the art in view of these teachings. Therefore, this invention is to be limited only by the following claims, which include all such embodiments and modifications when viewed in conjunction with the above specification and accompanying drawing.

The invention claimed is:

1. A collapsible upright wheeled walker device for augmenting an upright partially-supported walking gait on a walking surface for an unassisted user, the device comprising:

a frame having right, left, and back sides, the sides folding in on themselves for compact storage and transport;

two front wheel assemblies and two rear wheel assemblies coupled to the frame for supporting the frame above the walking surface and apportioned at the vertices of a polygonal footprint on the walking surface within which the user walks during use;

the frame having a simultaneously adjustable height and depth provided by lock-in-place slidable supports that cooperate with slidable lock-in-place front-to-rear adjustable support braces;

wherein the frame collapses to a compact structure via V-folder hinges located at two posterior and four side hinges;

two upper supports each coupled to and disposed at an adjustable height above a respective frame side; and two handles, each coupled to a respective upper anterior support for gripping by the user, the handles disposed at a forward handle angle with respect to the device and having locking handbrake levers used to actuate a cable connected to a friction brake at each of the respective rear wheel assemblies.

2. The device of claim 1 wherein the V-folder hinges comprise:

two foldable frame support braces coupled in the middle with a hinge and rotatable on each of the brace ends; wherein two such V-folder hinges are on each of the right side frame and left side frame and fold by rotating upwards and wherein two V-folder hinges are on the top and bottom halves respectively of the posterior side of the apparatus and fold by rotating downwards.

3. The device of claim 2 further comprising:

a rotatable, lock-in-place crossbar assembly providing user safety and apparatus stability during use.

* * * * *